US006536629B2

(12) United States Patent
van der Heijden

(10) Patent No.: US 6,536,629 B2
(45) Date of Patent: Mar. 25, 2003

(54) AEROSOL FOR DISPENSING A LIQUID

(75) Inventor: Edgar Ivo Maria van der Heijden, Broek op Langedijk (NL)

(73) Assignee: Airspray N.V. (NL)

( * ) Notice: Subject to any disclaimer, the term of this patent is extended or adjusted under 35 U.S.C. 154(b) by 0 days.

(21) Appl. No.: 10/027,486

(22) Filed: Dec. 20, 2001

(65) Prior Publication Data

US 2002/0056730 A1 May 16, 2002

Related U.S. Application Data

(63) Continuation of application No. PCT/NL00/00441, filed on Jun. 23, 2000.

(30) Foreign Application Priority Data

Jun. 23, 1999 (NL) ..... 1012419

(51) Int. Cl.[7] ..... B67D 5/58
(52) U.S. Cl. ..... 222/190; 222/321.9; 239/110
(58) Field of Search ..... 222/190, 402.133, 222/321.7, 321.9, 108; 239/106, 110, 343

(56) References Cited

U.S. PATENT DOCUMENTS 4,932,567 A * 6/1990 Tanabe et al. ..... 222/190
5,458,289 A * 10/1995 Cater ..... 222/190
5,813,576 A * 9/1998 Iizuka et al. ..... 222/190
5,826,756 A 10/1998 Foster

FOREIGN PATENT DOCUMENTS

| | | |
|---|---|---|
| EP | 0 618 147 A2 | 10/1994 |
| FR | 2 748 407 | 11/1997 |
| GB | 1 509 827 | 5/1978 |
| JP | 63151370 | 6/1988 |
| JP | 09077115 | 3/1997 |
| JP | 09099259 | 4/1997 |

* cited by examiner

*Primary Examiner*—Gene Mancene
*Assistant Examiner*—Stephanie Willatt
(74) *Attorney, Agent, or Firm*—Hoffmann & Baron, LLP

(57) ABSTRACT

An aerosol for dispensing a liquid, in particular in the form of a foam, at least including a liquid container and a dispensing assembly which is coupled thereto. The dispensing assembly includes a liquid pump and an actuating head, the actuating head having a closed, circumferential protective cap. The aerosol furthermore includes a circumferential recess, into which the protective cap can move, which recess includes a closed inner wall, an outer wall and a base, and one or more outlet openings are present in the vicinity of the base of the recess, wherein the shape of the recess is such that the inner wall, on the side which is remote from the base, is at a radial distance p from the protective cap, which distance p is greater than the usual clearance distance of the protective cap with respect to the inner wall.

9 Claims, 4 Drawing Sheets

AEROSOL FOR DISPENSING A LIQUID

CROSS-REFERENCE TO RELATED APPLICATION

This is a continuation application of PCT/NL00/00441 filed Jun. 23, 2000, which PCT application claims the priority of Dutch patent application number 1012419 filed Jun. 23, 1999, herein incorporated by reference.

FIELD OF THE INVENTION

The invention relates to an aerosol for dispensing a liquid, in particular in the form of a foam, at least comprising a liquid container and a dispensing assembly which is coupled thereto at least in liquid-tight manner, the dispensing assembly comprising a liquid pump with a liquid inlet and a liquid outlet, and an actuating head, the actuating head comprising an outlet passage and a dispensing opening for dispensing the liquid, while the actuating head furthermore comprises a closed, circumferential protective cap, the aerosol comprising a circumferential recess, into which the protective cap can move, which recess comprises a closed inner wall, an outer wall and a base, and one or more outlet openings are present in the vicinity of the base of the recess.

BACKGROUND OF THE INVENTION

An aerosol of the type referred to above is known from JP-A-9-77115.

Aerosols of the type referred to in the introduction are used, inter alia, to dispense liquids as such, such as toothpaste, gel, etc. There are also aerosols which are intended to dispense atomized air/liquid mixtures, such as deodorant, hair sprays, paint, etc. However, the latter type of aerosol may also comprise foam-forming means, so that the aerosol is suitable for dispensing foam products, such as shaving foam, soap, shower foam, etc.

In the context of the present invention, the term liquid is understood as meaning both low-viscosity liquids and viscous liquids and pasty materials.

In the aerosol described in JP-A-9-77115 the inner wall of the annular recess forms a substantially vertical guide wall for the protective cap. In other words, during use, the protective cap moves up and down along this inner wall in very close proximity thereto.

In the case of personal hygiene products, the aerosol is frequently used in a damp environment, such as in a bathroom in the bath or under the shower. In the case of paint and other products, it is also necessary to prevent liquid products, such as the products to be dispensed or water, entering the dispensing assembly.

The aerosol described in JP-A-9-77115 is reasonably successful at preventing water which runs downwards along the protective cap, for example, finding it easy to enter the dispensing assembly at the liquid pump.

When the aerosol is used, by depressing the actuating head, a liquid will be dispensed by actuation of the liquid pump and emptying of the liquid pump chamber. If the actuating head is then released, the pump will move back towards its starting position, during which movement the pump chamber is filled with liquid. While the pump chamber is being filled, liquid is withdrawn from the liquid container. This volume of liquid which has been removed has to be compensated for by admitting air to the liquid container from the protective cap.

When the actuating head is depressed, the space which is enclosed by the actuating head and the inner wall of the annular recess will be reduced in size. When the actuating head moves back into its starting position, this volume will increase in size. This also has to be compensated for by admitting air.

In both cases, air will be drawn into the dispensing assembly between the inner wall of the annular recess and the protective cap. It is thus nevertheless possible for leakage water, possibly contaminated with dispensed liquid, conceivably in the form of a foam, to enter the dispensing assembly.

Products which are to be dispensed using aerosols are frequently sticky once they have dried and therefore, if they reach the dispensing assembly, can considerably impede and even completely disrupt operation thereof.

It is also the case that the liquids to be dispensed are frequently liquids which give rise to the formation of foam, with all the associated disadvantages.

It will be clear that it is also highly undesirable if there is any possibility of foreign substances from the environment entering the liquid container together with the leakage water.

OBJECT OF THE INVENTION

The object of the present invention is to provide a solution to the above problems.

SUMMARY OF THE INVENTION

The present invention provides for an aerosol for dispensing a liquid, in particular in the form of a foam, at least comprising a liquid container and a dispensing assembly which is coupled thereto at least in liquid-tight manner, the dispensing assembly comprising a liquid pump with a liquid inlet and a liquid outlet, and an actuating head, the actuating head comprising an outlet passage and a dispensing opening for.dispensing the liquid, while the actuating head furthermore comprises a closed, circumferential protective cap, the aerosol furthermore comprising a circumferential recess, into which the protective cap can move, which recess comprises a closed inner wall, an outer wall and a base, and one or more outlet openings are present in the vicinity of the base of the recess, characterized in that the shape of the recess is such that the inner wall, on the side which is remote from the base, is at a radial distance p from the protective cap, which distance p is greater than the usual clearance distance of the protective cap with respect to the inner wall.

Due to the particular shape of the inner wall of the recess in the aerosol according to the invention, any liquid which is sucked up during the restoring movement of the dispensing head can be temporarily accommodated in the space between the inner wall which is of particular design and the protective cap. Once the restoring movement has been completed, at the latest, the liquid can easily flow out of this space to the outlet openings or can be pressed out during a subsequent actuation.

The particular design of the aerosol according to the invention makes it virtually impossible for water to enter the dispensing assembly from outside the aerosol. All the leakage water will be discharged through the outlet opening(s) in the base of the recess to the environment.

The available clearance distance is understood as meaning a distance p as disclosed, for example, in JP-A-9-77115. This distance p is such that there is suitable guidance provided between the inner wall of the recess and the protective cap, and will in practice be relatively small. This distance p will be selected in such a manner that the protective cap can be successfully guided by the inner wall without unnecessary friction.

Advantageously, the distance p according to the invention is at least 2 mm, or the distance p is greater than or equal to 0.1 times the internal diameter d of the protective cap. The distance p is preferably greater than or equal to 0.3 times the internal diameter of the protective cap, and more preferably greater than or equal to 0.5 times the internal diameter of the protective cap. It will be clear that the distance p is most preferably as great as possible.

According to the invention, various shapes of the inner wall are possible. For example, this inner wall may comprise a substantially straight cylinder with a diameter which is significantly smaller than the internal diameter d of the protective cap, the distance p between the straight cylinder and the inside of the protective cap being greater than the available clearance distance as defined above. In this embodiment, it will be impossible for any liquid to be sucked up, since the distance between the inner wall and the protective cape is too great.

Preferably, however, the inner wall of the recess, at least in the vicinity of the side which is remote from the base of the recess, is of conical shape which widens towards the base. Particularly in the latter design, which will be explained in more detail below in the figure, the conical shape of the inner wall will prevent any formation of bubbles in the space between the inner wall and the protective cap. Bubbles which form in that area will be easy to break up due to the increase in their surface area which occurs.

The basis of the present invention is that there is no liquid sucked up between the inner wall of the recess and the protective cap, or that a space is formed between the inner wall and the protective cap, in which any liquid which is sucked up can be temporarily stored and then discharged. These aspects will be explained in more detail below in the description of the figures.

Preferably, the dispensing assembly furthermore comprises an air pump with an air inlet and an air outlet. The present invention offers particular advantages if there is an air pump present. When the air pump chamber has been emptied, for example after an atomized liquid or a foam has been dispensed, this chamber has to be refilled with air from the environment. If, at that moment, water is present in the dispensing assembly, there is a high risk of it being sucked into the air pump chamber via the air inlet. Not only does this impede the operation of the air pump, it also disrupts the mixing ratio between the air and liquid. The mixing ratio is of essential import for many air/liquid mixtures which are to be dispensed. In practice, this applies in particular to so-called foam formers.

A foam former is an aerosol which comprises foam-forming means. Foam-forming means are, for example, one or more small meshes in the outlet passage. A foam is formed by mixing air and liquid and then passing it through the meshes. If additional leakage water, for example, is mixed with the air and the liquid, in the most serious case there will be no foam formed at all.

The outlet opening(s) in the base of the recess may, if necessary, be in communication with outlet means which guide the water to outside the aerosol.

In a particular embodiment of the aerosol according to the invention, the air pump and the liquid pump are designed as an assembly of two concentric piston pumps. Particularly with concentric piston pumps of this nature, it is imperative that any leakage of water into the dispensing assembly in the vicinity of the pumps be avoided. All this will be explained in more detail below in the description of the figures.

Advantageously, the internal diameter of the protective cap of the actuating head is greater than the external diameter of the piston pumps which are present. In this way, the pumps are very well protected against the penetration of water.

Preferably, the recess according to the invention forms a part of the dispensing assembly.

The invention furthermore provides a dispensing assembly which is intended for an aerosol according to the invention.

The invention will be explained in more detail below with reference to the appended drawing.

DETAILED DESCRIPTION OF THE DRAWINGS

Figure 1:
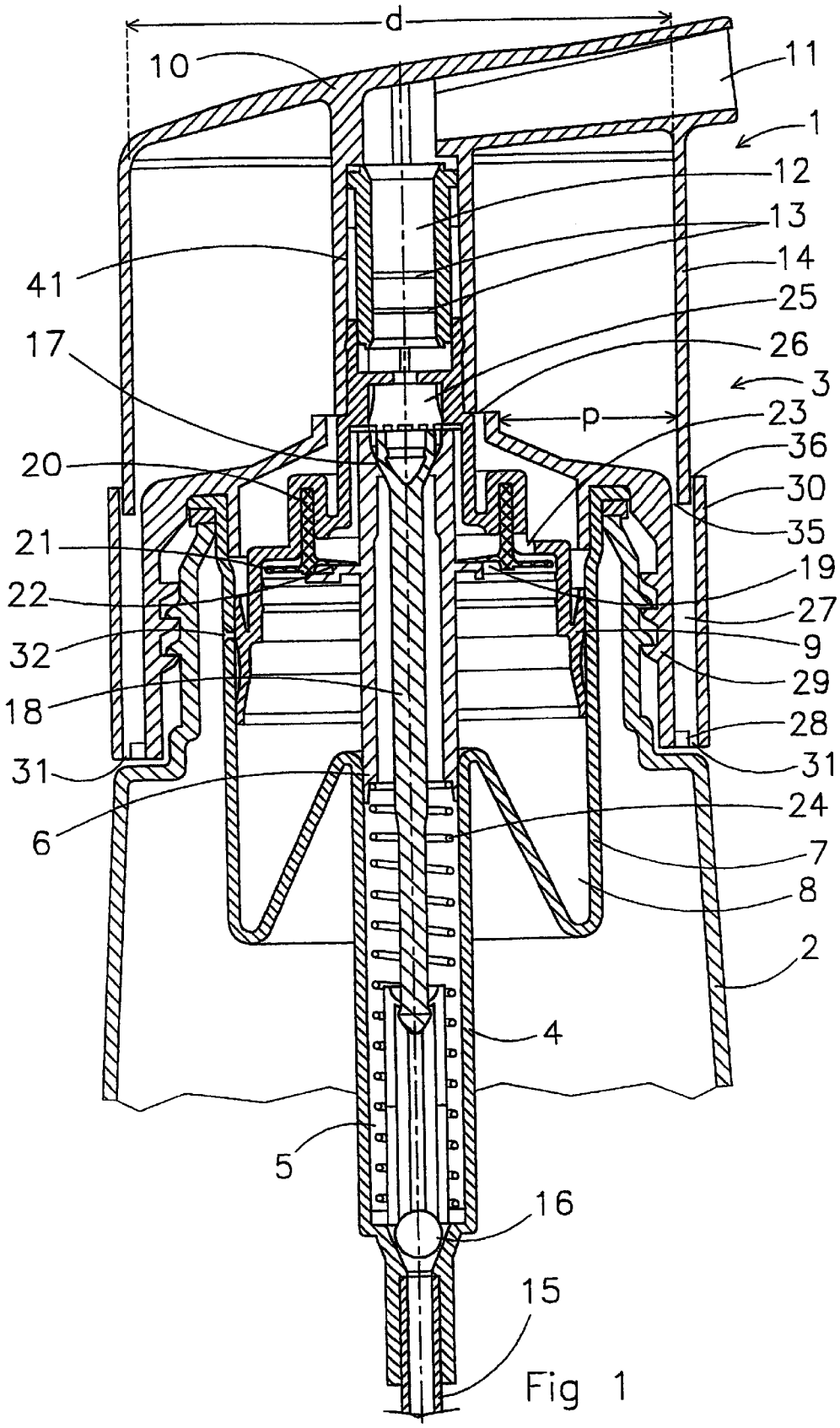
FIG. 1 shows an aerosol according to the invention in the neutral position.

FIG. 1 shows an aerosol 1 according to the invention for dispensing foam, comprising a liquid container 2 and a dispensing assembly 3. The dispensing assembly 3 is screwed onto the liquid container 2. The dispensing assembly 3 comprises a liquid pump 4 with a liquid pump chamber 5 and a liquid pump piston 6. Furthermore, there is an air pump 7 with an air pump chamber 8 and an air pump piston 9. Both pistons 6 and 9 are coupled to an actuating head 10.

The actuating head 10 comprises a dispensing opening 11 and an outlet passage 12, two small meshes 13 being present in the outlet passage 12 in order to form a foam. The head 10 furthermore comprises a circumferential protective cap 14.

A riser tube which extends close to the bottom of the liquid container 2 and serves as an inlet for the liquid pump 4 is denoted by 15. Furthermore, the inlet to the liquid pump 4 contains a non-return valve in the form of a ball 16. The outlet from the liquid pump 4 is situated at the location indicated by 17 and can be closed off by means of a rod-like non-return valve component 18.

The outlet from the air pump 7 is situated at the location indicated by 19. A flexible sealing component is denoted by 20, comprising two annular, resilient sealing lips 21 and 22 which are used to close off and open the inlet 23 and the outlet 19 of the air pump 7.

The dispensing assembly 3 is provided with restoring means which comprise a spring 24.

When the foam former is in use, it is possible to press the actuating head 10, with the result that the pistons 9 and 6 of the air pump 7 and the liquid pump 4, respectively, are moved downwards, with the result that the volumes of the corresponding piston chambers 8 and 5, respectively, are reduced and air and liquid are dispensed to a so-called mixing chamber 25, where air and liquid are mixed, which mixture is then passed through the two small meshes 13, into the outlet passage 12, and leaves the dispensing opening 11 in the form of a foam.

After foam has been dispensed, the actuating head 10 is released and will be returned to its starting position by the spring 24. During this return movement, the non-return valve 16 will open and the liquid pump chamber 5 will fill with liquid from the liquid container 2, while the air pump chamber fills with air.

A vent opening for the liquid container 2 is denoted by 32 and is used to supply air to the interior of the liquid container 2 in order to compensate for the amount of liquid which has been removed from the liquid container. Leakage water could also enter the liquid container 2 via this opening. Naturally, this is undesirable.

The aerosol shown in FIG. 1 furthermore comprises a circumferential recess 27 with a base 28, an inner wall 29 and an outer wall 30. In the base 28 there are a plurality of outlet openings 31 which are in communication with the environment. The inner wall 29 extends as far as an annular gap 26. The gap 26 is situated between the inner wall 29 and the wall 41 of the outlet passage 12. Advantageously, the inner wall 29 according to the invention extends, as far as possible, to the vicinity of the wall 41.

During use, the protective cap 14 moves up and down in the recess 27. It is clear that the air inlet opening 23 of the air pump and the vent opening 32 in this case are situated in a space which is in communication with the environment only via the gap 26 between the protective cap 14 and the inner wall 29 and the gap 35 and 36. In other words, the inner wall 29 substantially adjoins the actuating head 10 in the vicinity of the outlet passage 12.

The distance p between the inner wall 29 and the protective cap 14 in the vicinity of that side of the inner wall 29 which is remote from the base and the internal diameter d of the protective cap 14 are also indicated in the figures.

Figure 2:
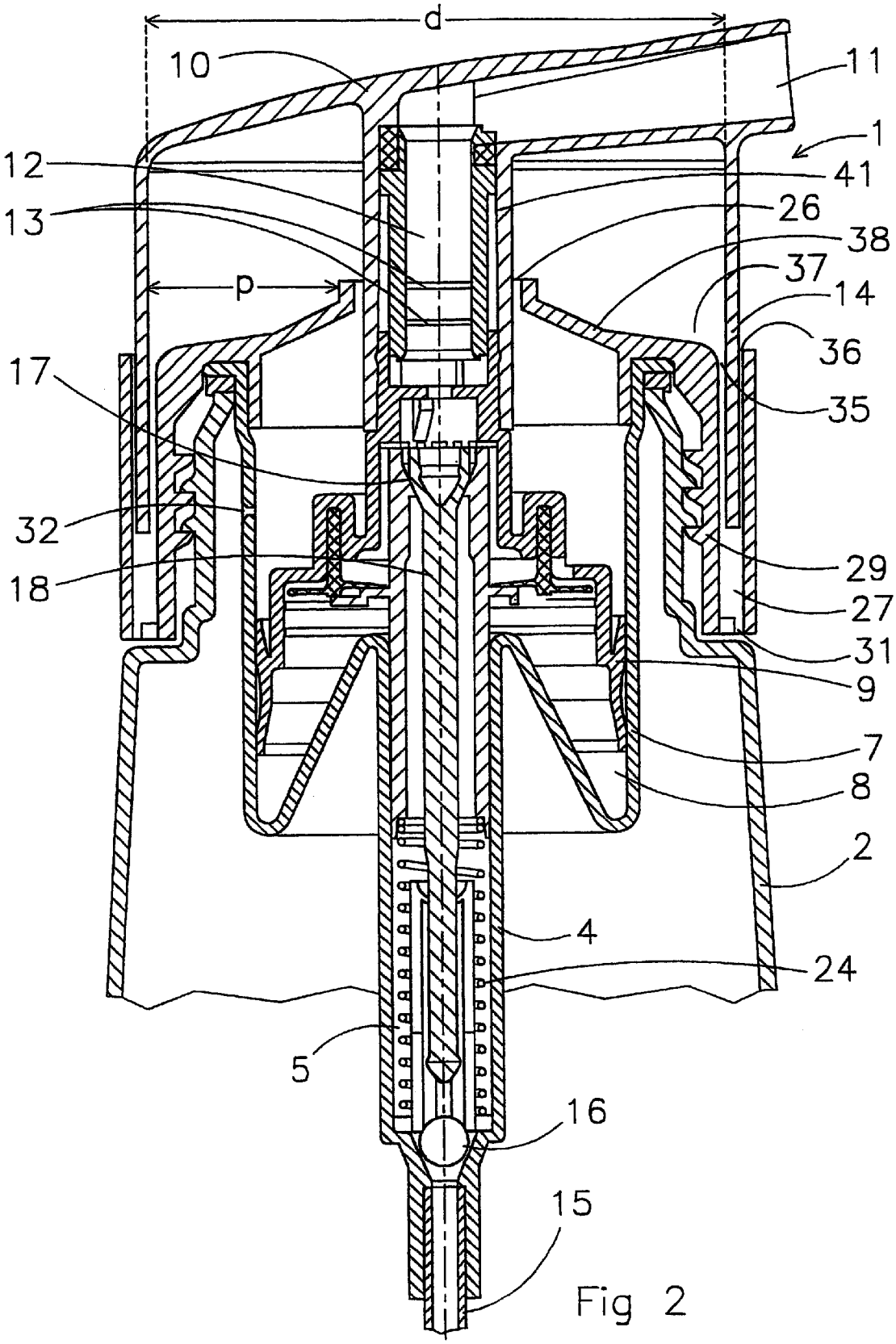
FIG. 2 shows the aerosol shown in FIG. 1 during or just after dispensing of foam.

FIG. 2 shows the aerosol from FIG. 1 in the depressed position, i.e. during or immediately after dispensing of foam. Corresponding components are denoted by the same reference numerals.

Figure 3:
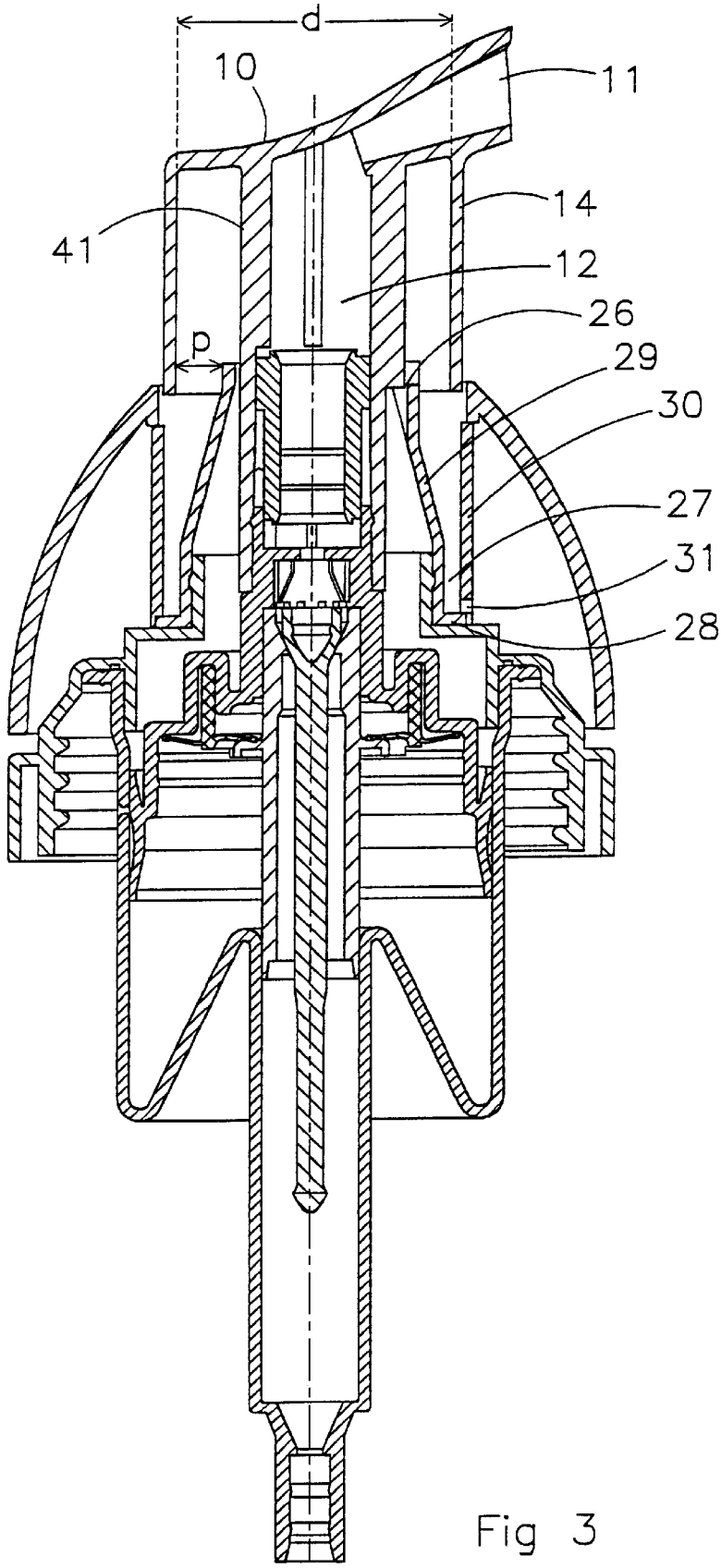
FIG. 3 shows another design of an aerosol according to the invention for dispensing foam.

If, in the aerosol according to the invention as shown in FIGS. 2 and 3, water should run along the protective cap 14, this water always passes only into the recess 27 and can flow out to the environment via the dispensing openings 31 in the base 28 of this recess. It is virtually impossible for water to enter the protective cap via 35 and then to reach the area of the pumps via the gap 26.

If, during use, the aerosol is depressed as shown in FIG. 2, the space enclosed by the protective cap 14 and the inner wall 29 is reduced in size and a quantity of air is pressed out to the environment via gaps 35 and 36 and the outlet openings 31. It will be clear that a portion of this air is required in order to compensate for the increase in volume of the space above the air piston 9. However, when the actuating component 10 is released and it returns to the at-rest position, air will be sucked in via the gap 35. If, at that moment, there is liquid in the recess 27, this recess will collect in the space between the protective cap 14 and the inner wall 29, at the location indicated by 37. Due to the locally conical design of the inner wall 29, as indicated at 38, any such liquid which is sucked up will never be able to reach the dispensing assembly via 26. The water will be pressed out via 35 during the subsequent actuating stroke. Preferably, however, the gap 35 is sufficiently large for any liquid which has been sucked up to be able to flow out of the space 37 to the outlet openings 31 in the at-rest position.

FIG. 3 shows a preferred embodiment of the aerosol 1 according to the invention, in which all the components are identical to those shown in the previous figures, but the inner wall 29 is of conical design over virtually its entire length. This again offers the considerable advantage that if the recess 27 contains liquid, for example water, which is sucked up into the space defined by the conical inner wall 29 and the protective cap 14, this liquid cannot reach the dispensing assembly via 26.

Figure 4:
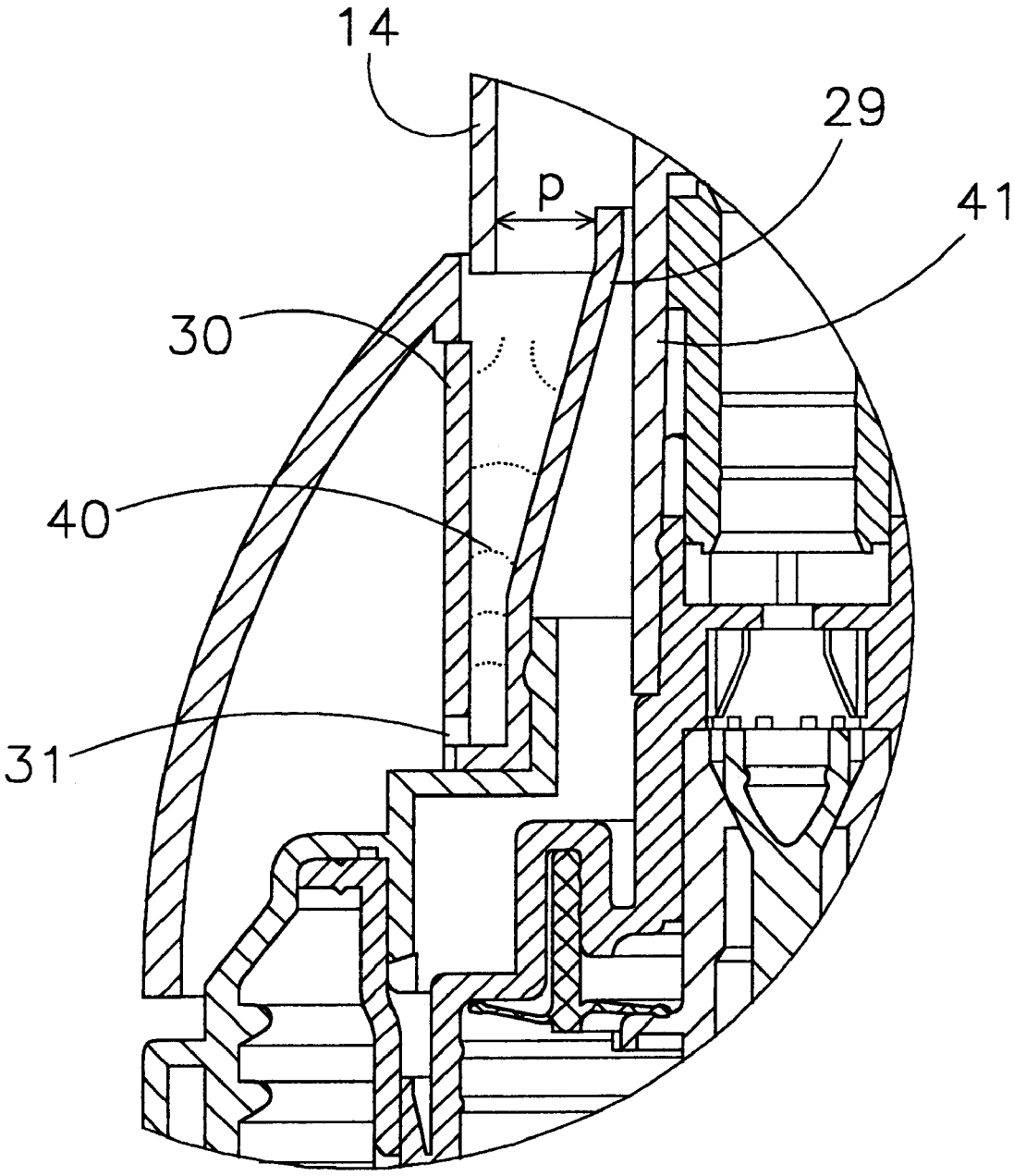
FIG. 4 shows an enlarged view of the annular recess shown in FIG. 3.

If, in addition to liquid, air is also sucked through the liquid situated in the recess 27, for example via the outlet openings 31, the surface area of any bubbles which form, due to the conical shape of the inner wall 29, is increased to such an extent that these bubbles will easily break-up. This can be seen clearly in FIG. 4, which shows an enlarged view of the recess 27 shown in FIG. 3. In this figure, the formation of a bubble and the way in which it breaks up is indicated by dashed lines 40.

What is claimed is:

1. An aerosol for dispensing a liquid, in particular in the form of a foam, at least comprising a liquid container and a dispensing assembly which is coupled thereto at least in liquid-tight manner, the dispensing assembly comprising a liquid pump with a liquid inlet and a liquid outlet, and an actuating head, the actuating head comprising an outlet passage and a dispensing opening for dispensing the liquid, while the actuating head furthermore comprises a closed, circumferential protective cap, the aerosol furthermore comprising a circumferential recess, into which the protective cap can move, which recess comprises a closed inner wall, an outer wall and a base, and one or more outlet openings are present in the vicinity of the base of the recess, wherein the shape of the recess is such that the inner wall, on the side which is remote from the base, is at a radial distance p from the protective cap, which distance p is greater than the usual clearance distance of the protective cap with respect to the inner wall.

2. Aerosol according to claim 1, wherein the distance p is at least 2 mm.

3. Aerosol according to claim 1, wherein the protective cap has an internal diameter d, and wherein the distance p being greater than or equal to 0.1 times the internal diameter d of the protective cap.

4. Aerosol according to claim 1, wherein the inner wall of the recess, at least in the vicinity of the side which is remote from the base of the recess, is of a conical shape which widens towards the base.

5. Aerosol according to claim 1, wherein the dispensing assembly furthermore comprises an air pump with an air inlet and an air outlet.

6. Aerosol according to claim 1, wherein the dispensing assembly furthermore comprises an air pump with an air inlet and an air outlet, and wherein the air pump and the liquid pump are designed as an assembly of two concentric piston pumps.

7. Aerosol according to claim 5, wherein the protective cap of the actuating head has an internal diameter, the liquid pump and the air pump have an external diameter, the air pump and the liquid pump are designed as an assembly of two concentric piston pumps, the internal diameter of the protective cap of the actuating head being greater than the external diameter of the piston pumps which are present.

8. Aerosol according to claim 1, wherein the recess forms a part of the dispensing assembly.

9. Dispensing assembly intended for an aerosol comprising a liquid pump with a liquid inlet and a liquid outlet, and an actuating head, the actuating head comprising an outlet passage and a dispensing opening for dispensing a liquid, while the actuating head furthermore comprises a closed, circumferential protective cap, the aerosol furthermore comprising a circumferential recess, into which the protective cap can move, which recess comprises a closed inner wall, an outer wall and a base, and one or more outlet openings are present in the vicinity of the base of the recess, wherein the shape of the recess is such that the inner wall, on the side which is remote from the base, is at a radial distance p from the protective cap, which distance p is greater than the usual clearance distance of the protective cap with respect to the inner wall.

* * * * *